US005101241A

United States Patent [19]

Watanabe

[11] Patent Number: 5,101,241

[45] Date of Patent: Mar. 31, 1992

[54] TELESCOPIC PAPER GUIDE MEANS MOVABLE TO SELECTED RECEIVING TRAYS

[75] Inventor: Junji Watanabe, Yokohama, Japan

[73] Assignee: Kabushiki Kaisha Toshiba, Kawasaki, Japan

[21] Appl. No.: 615,056

[22] Filed: Nov. 19, 1990

[30] Foreign Application Priority Data

Nov. 20, 1989 [JP] Japan ..... 1-301612

[51] Int. Cl.[5] ..... G03G 21/00

[52] U.S. Cl. ..... 355/323; 271/200; 271/296; 271/300; 355/321

[58] Field of Search ..... 355/321, 323; 271/200, 271/296, 300

[56] References Cited

U.S. PATENT DOCUMENTS 4,830,358 5/1989 Fazio et al. ..... 271/300

FOREIGN PATENT DOCUMENTS 176770 7/1989 Japan ..... 271/296
176773 7/1989 Japan ..... 271/296
176775 7/1989 Japan ..... 271/296
187135 7/1989 Japan ..... 271/296
187172 7/1989 Japan ..... 271/296
187173 7/1989 Japan ..... 271/296
2-29577 6/1990 Japan .
2-29578 6/1990 Japan .

*Primary Examiner*—A. T. Grimley
*Assistant Examiner*—J. E. Barlow, Jr.
*Attorney, Agent, or Firm*—Foley & Lardner

[57] ABSTRACT

An apparatus for sorting sheets of paper discharged from an image forming apparatus includes a tray unit having a plurality of receiving trays for receiving the discharged sheets of paper. The trays are stacked in a predetermined direction at predetermined intervals. A movable unit is arranged to be movable in the predetermined direction along the tray unit. The sheets of paper discharged from the image forming apparatus are guided to the movable unit by a movable guide. The movable unit has a feeding unit for feeding the guided sheets into the tray unit. The feeding unit is movable between a feeding position adjacent to the tray unit and a remote position remote from the tray unit. By a shifting mechanism, the feeding unit is moved to the feeding position when the guided sheets are being fed, and is moved to the remote position when the movable member moves.

13 Claims, 7 Drawing Sheets

TELESCOPIC PAPER GUIDE MEANS MOVABLE TO SELECTED RECEIVING TRAYS

BACKGROUND OF THE INVENTION

1. Field of the Invention

The present invention relates to an apparatus which is associated with an image forming apparatus, such as an electrophotographic copying apparatus, for sorting sheets of paper discharged from the image forming apparatus.

2. Description of the Related Art

In recent years, image forming apparatuses are widely used, and a variety of image forming apparatuses having a sorter are now in practical use.

A sorter of this kind is generally provided with a paper receiving unit which comprises a plurality of paper receiving trays vertically piled up. The entire receiving unit is vertically moved to successively place a desired receiving tray in front of the discharge rollers of the image forming apparatus, thereby receiving printed sheets of paper discharged from the apparatus and storing them.

Since, however, the whole paper receiving unit having such a structure must be moved along with the stored paper sheets, these sorters are complicated and large. In addition, the sorter requires a large driving force and power, resulting in increase in manufacturing cost.

A sorter disclosed in a Published Examined Japanese Patent Application No. 2-29577, for instance, includes a paper receiving unit having a plurality of paper receiving trays, a movable guide for guiding the paper sheets discharged from the image forming apparatus to their respective paper receiving trays, and feed rollers arranged on the end of the guide in such a manner that the rollers vertically move in a direction in which the paper receiving trays are piled up, in interlock with the movement of the guide, for feeding the guided paper sheets into their respective paper receiving trays. A sorter with this structure can surely solve the above problem.

However, in the above-mentioned sorter, a space is defined between the paper receiving unit and the feed rollers so as to prevent the movement of the discharge rollers from being obstructed by the receiving unit. This space may hamper the sure feeding of a paper sheet from the feed rollers to the paper receiving tray. Specifically if a space exist between the feed rollers and the receiving tray, a paper sheet is not fed completely into the receiving tray and the rear end of the paper sheet projects from the tray into the space. The projected portion of the sheet may hinder the sorting and storing operations for the following paper sheets, resulting in a paper jam.

SUMMARY OF THE INVENTION

The present invention is made in consideration of the above circumstances, and its object is to provide an apparatus which can surely sorts the discharged paper sheets, and which is simple in structure and low in cost.

To achieve the above object, an apparatus according to the present invention comprises:

means for receiving sheets of paper, said receiving means having a plurality of paper receiving portions;

means for feeding the paper sheet from a predetermined position into the receiving means;

first moving means for moving said feeding means to a position facing a specified one of the receiving portions; and second moving means for moving the feeding means such that said feeding means approaches from said position to the receiving means when the feeding means feeds the sheets of paper into the receiving means, after the movement of the feeding means by the first moving means.

With the apparatus having the above construction, the feeding means is made to move toward the paper receiving means to eliminate any space between the paper receiving means and the feeding means, upon feeding paper sheets into the receiving means. Therefore, paper sheets can be securely fed into the receiving means without accident, which sometimes happens to the conventional apparatuses, that the rear end of the fed paper sheet projects out of the receiving portion. Moreover, the movement of the movable unit will never be hampered by the feeding means and the paper receiving means, since the feeding means is moved to the remote position when the movable unit moves. Therefore, the sheets of paper successively discharged will surely be sorted and accumulated into the paper receiving means.

In addition, each paper receiving portion of the paper receiving means has a receiving portion which receives a part of the discharge means when the feeding means is moved to the paper feeding position. Thus, paper sheets will much surely be fed from the feeding means into the receiving means.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 through 12 show an image forming apparatus with a sorter according to an embodiment of the present invention, in which:

FIG. 1 is a sectional view schematically showing the whole of the image forming apparatus, FIG. 2 is a sectional view schematically showing a fixing portion of the image forming apparatus and the sorter, FIG. 3 is a perspective view schematically showing the sorter, FIG. 4 is a sectional view schematically showing the sorter, FIG. 5 is a perspective view schematically showing a movable unit of the sorter, FIG. 6 is an enlarged side view showing part of a roller moving mechanism, FIGS. 7 and 8 are respectively a side view and a perspective view, each schematically showing the sorter which is in a state that a feed roller unit stays at its remote position, FIGS. 9 and 10 are respectively a side view and a perspective view, each schematically showing the sorter which is in a state that the feed roller unit stays at its discharge position, FIG. 11 is a perspective view of a paper discharge side of the image forming apparatus to which a tray unit of the sorter is fitted, and FIG. 12 is a perspective view of the paper discharge side of the image forming apparatus from which the tray unit of the sorter is removed.

DETAILED DESCRIPTION OF THE PREFERRED EMBODIMENTS

An image forming apparatus having a sorter according to an embodiment of the present invention will now be explained with reference to the accompanying drawings.

Figure 1:
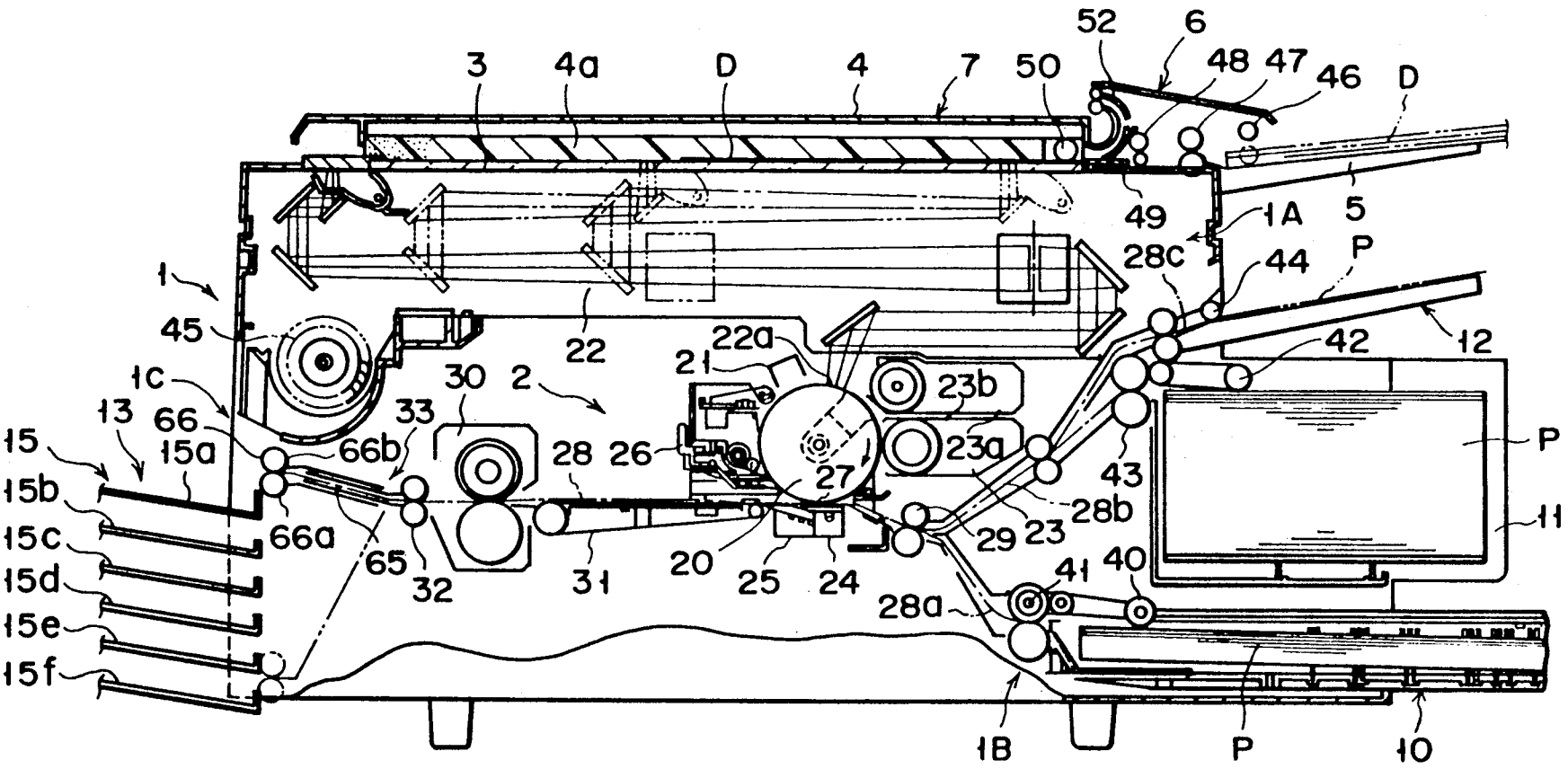

FIG. 1 shows an internal structure of the entire image forming apparatus. The image forming apparatus has a body 1, in which an image forming process unit 2 is arranged for performing an image forming processes such as charging, exposure, development, transfer, cleaning, fixation, and so forth. The body 1 has at its upper surface an automatic document feeder 7. The automatic document feeder (ADF) 7 comprises a document holding cover 4, which is freely opened or closed and has a platen sheet 4*a* for holding a document D placed on a document table or a platen glass 3, and a document feeding mechanism 6 for picking up documents D one by one from a document tray 5, automatically feeding them between the platen glass 3 and the platen sheet 4*a* in succession, and discharging them onto the document holding cover 4. On the the front edge of the upper surface of the body 1 is provided an operation panel (not shown in the drawings) which includes ten keys, an information display, a copy key, and the like.

On the right side of the body 1 are fitted a paper cassette 10 and a large scale paper feeder (LCF) 11, both of which contain blank sheets of paper P to be fed to the image forming process unit 2. A table 12 for manually feeding paper sheets is provided at the right side of the body 1.

On the left side of the body is fitted a sorter 13 according to the present invention, for sorting and storing sheets of paper having a fixed image on their surfaces.

The image forming process unit 2 has a photoconductive drum 20, as an image carrier, which is placed at the substantially center of the body 1. Around the drum 20 are successively arranged in its rotating direction a charging device 21, an exposing portion 22*a* of an exposing device 22, a developing device 23 comprising an upper developing unit 23*a* for developing color images and a lower developing unit 23*b* for developing monochrome images, a transfer device 24, a peeling device 25, and a cleaning device 26.

In the body 1 is defined a paper conveying path 28 for conveying a sheet of paper P, which is either automatically fed from the paper cassette 10 or the large scale paper feeder 11, or manually fed through the manual feeding table 12, to the sorter 13 via an image transfer portion 27 located between the drum 20 and the transfer device 24.

A pair of alignment rollers 29 and a fixing device 30 are arranged on the paper conveying path 28 at its upper course side and lower course side, with respect to the image transfer portion 27. Between the image transfer portion 27 and the fixing device 30 is provided a absorption transfer mechanism 31. Between the fixing device 30 and a tray unit 15, which functions as a receiving unit of the sorter 13, a pair of paper discharge rollers 32 and a paper feeding mechanism 33 for sorting and feeding sheets of paper P to receiving tables 15*a* through 15*f* as receiving portions of the tray unit 15.

Adjacent to a cassette fitting portion, to which the paper cassette 10 is detachably fitted, are provided pick-up rollers 40 which are supported on a swingable arm and pick up the sheets of paper P one by one from the cassette 10, and a separating/feeding mechanism 41 comprising separating rollers and feeding rollers, for successively receiving the sheets of paper P from the pick-up rollers 40 and feeding them into a first branch conveying path 28*a*, which is an upper course of the paper conveying path 28. Adjacent to the paper feeder 11 are provided pick-up rollers 42 which are supported on a swingable arm and pick up the sheets of paper P one by one from the feeder 11, and a separating/feeding mechanism 43 comprising separating rollers and conveying rollers, for successively receiving the sheets of paper P from the pick-up rollers 42 and feeding them into a second branch conveying path 28*b*, which is another upper course of the paper conveying path 28. Adjacent to the manual feeding table 12 is provided a pair of feed rollers 44 for successively feeding the manually fed sheets of paper into a third branch conveying path 28*c* which joins the second branch conveying path 28*b*.

A cooling fan 45 is arranged above the discharge rollers 32 in the body 1.

The image forming apparatus having the above structure is divided into an upper unit 1A and a lower unit 1B. The upper unit 1A is hinged to the lower unit to be rotatable in a clockwise direction around a pivot (not shown), and contacts the lower unit in its closed position. The paper conveying path 28 is located at the interface between the upper and lower units Al and A2. Thus, an access to the upper surface of the paper conveying path 23 may be ensured between the pair of alignment rollers 29 and the paper feeding mechanism 33.

The automatic document feeder (ADF) 7 includes pick up rollers 46 which can vertically move to be in contact with or to be apart from documents D set on the document tray 5, a document pick up means 47 having feed rollers and separating rollers, for picking up the documents one by one, and alignment rollers 48. These rollers are made to rotate in a predetermined direction by means of a drive system (not shown). There is provided a righthand scale 49 which can freely revolve around a shaft of the lower rollers of the alignment rollers 48. The right-hand scale is driven by a solenoid (not shown).

Feed rollers 50, which rotate while being in contact with the right end of the upper surface of the platen glass 3, is provided at the left side of the right-hand scale 49. The rollers 50 are made to rotate first in a forward direction and then in a backward direction by means of the drive system, each time they receive a document D from the automatic feeder 7, so that the documents D may be placed on and then discharged from the platen glass 3 one after another.

Now, the sorter 13 will be explained in detail.

Figure 2:
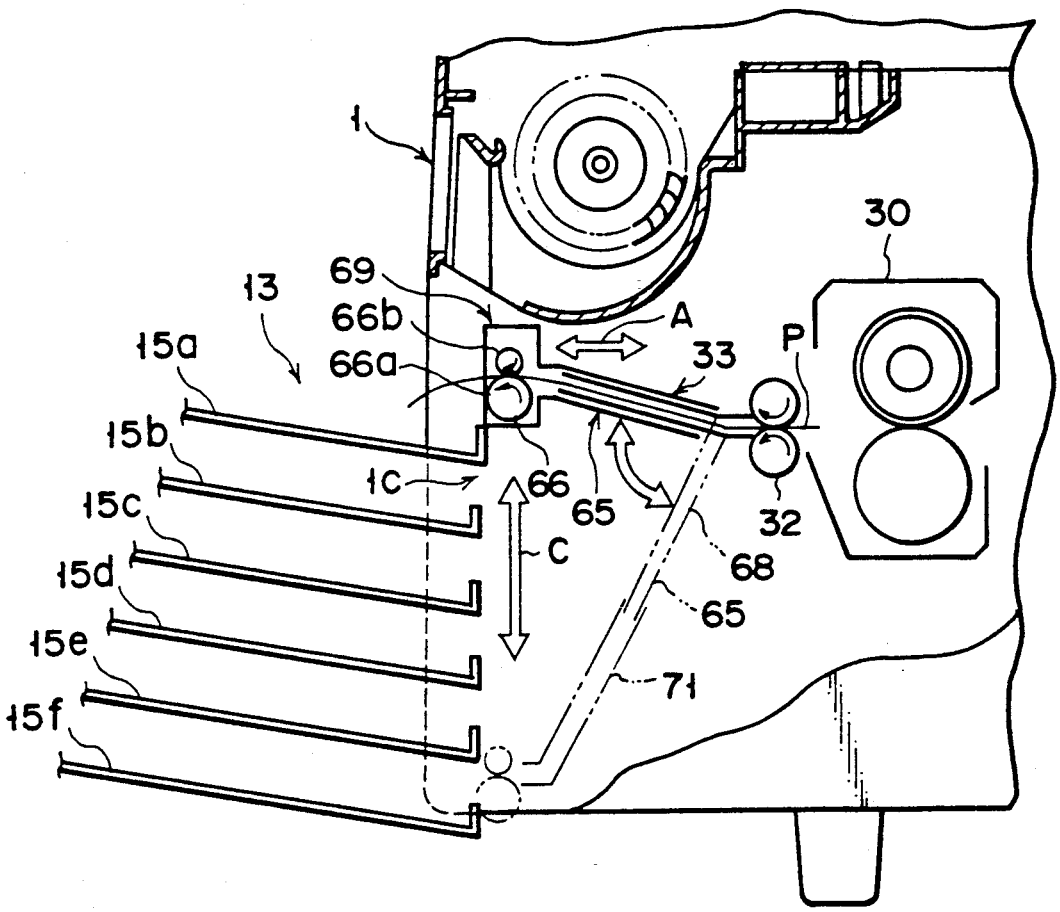

As shown in FIG. 2, the sorter 13 is detachably attached to a fitting portion 1*c* formed at the left side wall of the apparatus body 1, and comprises the tray unit 15 for receiving and storing sheets of paper P discharged from the image forming apparatus, and the feeding mechanism 33 arranged to be continued with the discharging rollers 32, for feeding the sheets of paper P having passed through the rollers 32 into the tray unit 15.

Figure 3:
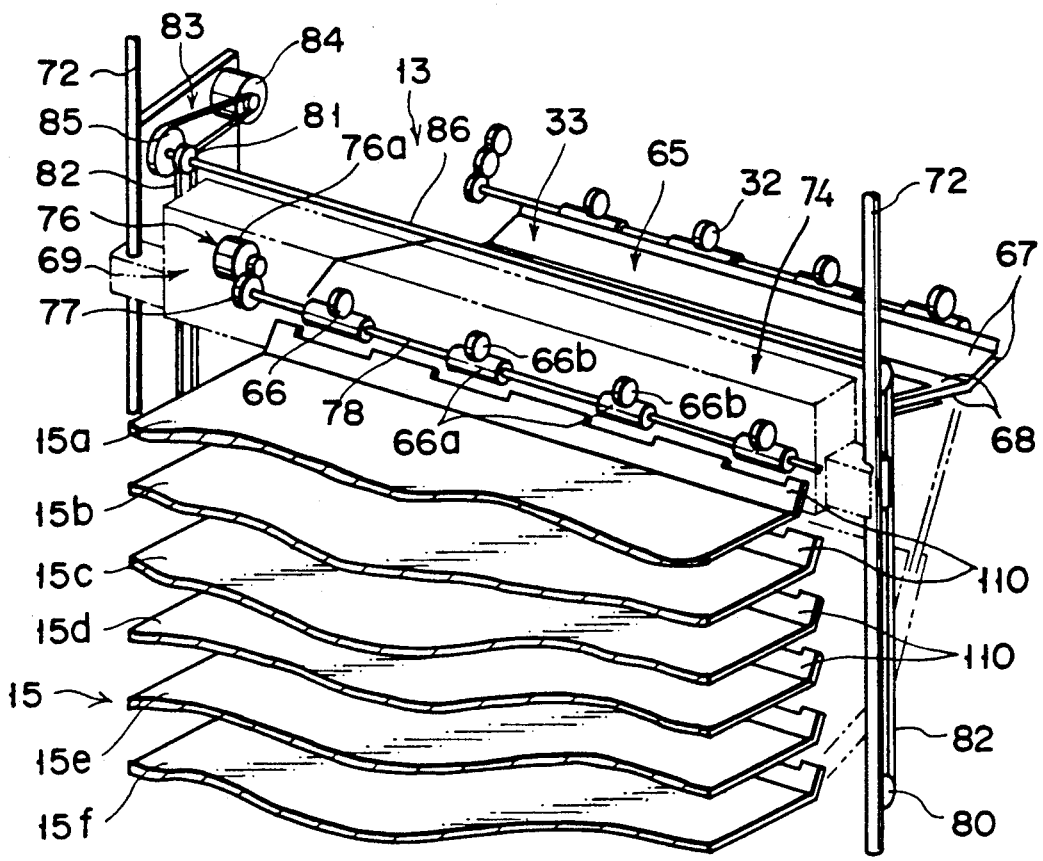
Figure 4:
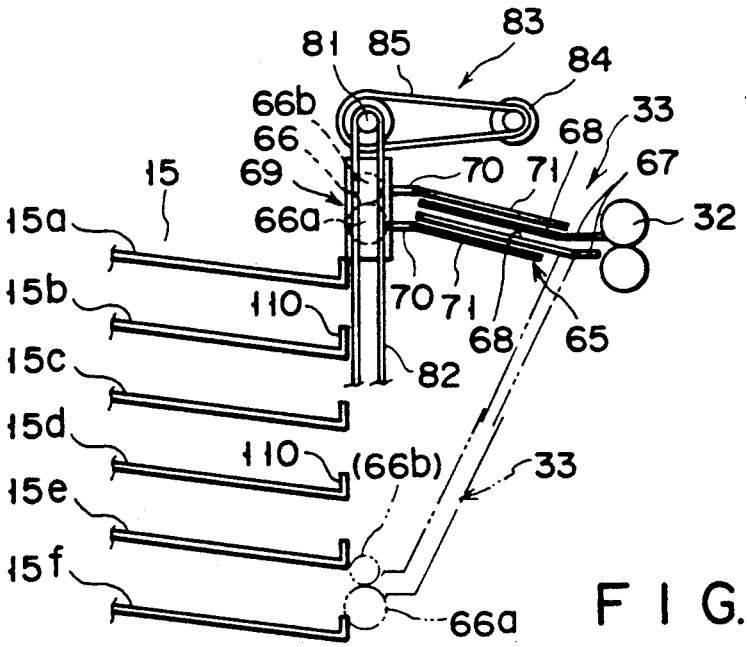

As shown in FIGS. 2 through 4, the tray unit 15 has a plurality of, for instance, six receiving trays 15*a* through 15*f*. These trays are vertically piled up with predetermined intervals. Each tray extends from the body 1 with being slightly inclined upward, and provided with a side wall 110 which is erected along the side edge of the tray located close to the body 1. The feeding mechanism 33 includes a movable guide 65 and a movable unit 69 which is connected to the outlet of the movable guide and vertically movable beside the tray unit 15.

The movable guide 65 comprises a pair of parallel guide plates 57 which are fixed inside the body 1 and horizontally extend from the discharging rollers 32, a pair of first parallel movable guide plates 68 which are respectively pivoted on the extended ends of the guide plates 67, a pair of parallel guide plates 70 which are integrally formed with the movable unit 69 and extend from the unit 69 towards the discharging rollers 32, and a pair of second parallel movable guide plates 71 which are respectively pivoted on the extended ends of the guide plates 70. The first guide plates 67 are slidably fitted into the second guide plates 71. Therefore, the movable guide 65 contracts or extends while it swings upward or downward in response to the upward or downward movement of the movable unit 69. The inlet of the guide 65 is defined by the guide plates 67 and the outlet of the guide 65 is defined by the guide plates 70.

As shown in FIGS. 3 through 6, the movable unit 69 includes a horizontally extending movable rest 73 which is guided by a pair of guide rods 72 to be vertically movable beside the side walls 110 of the receiving trays, and a feed roller unit 74 as feeding means, which is mounted on the movable rest 73. The movable rest 73 has two ends which ar respectively fixed to endless belts 82 stretched over between two pairs of pulleys 80 and 81 which are supported by support posts (not shown). Thus, the movable rest 73 ascends or descends through the belts 82 when the pulleys 81 are rotated by a drive section 83 provided on the movable rest 73. The drive section 83 includes a pulse motor 84 and a power transmitting system 85 which has a pulley and a belt for transmitting the driving force of the motor 84 to a shaft 86.

Figure 5:
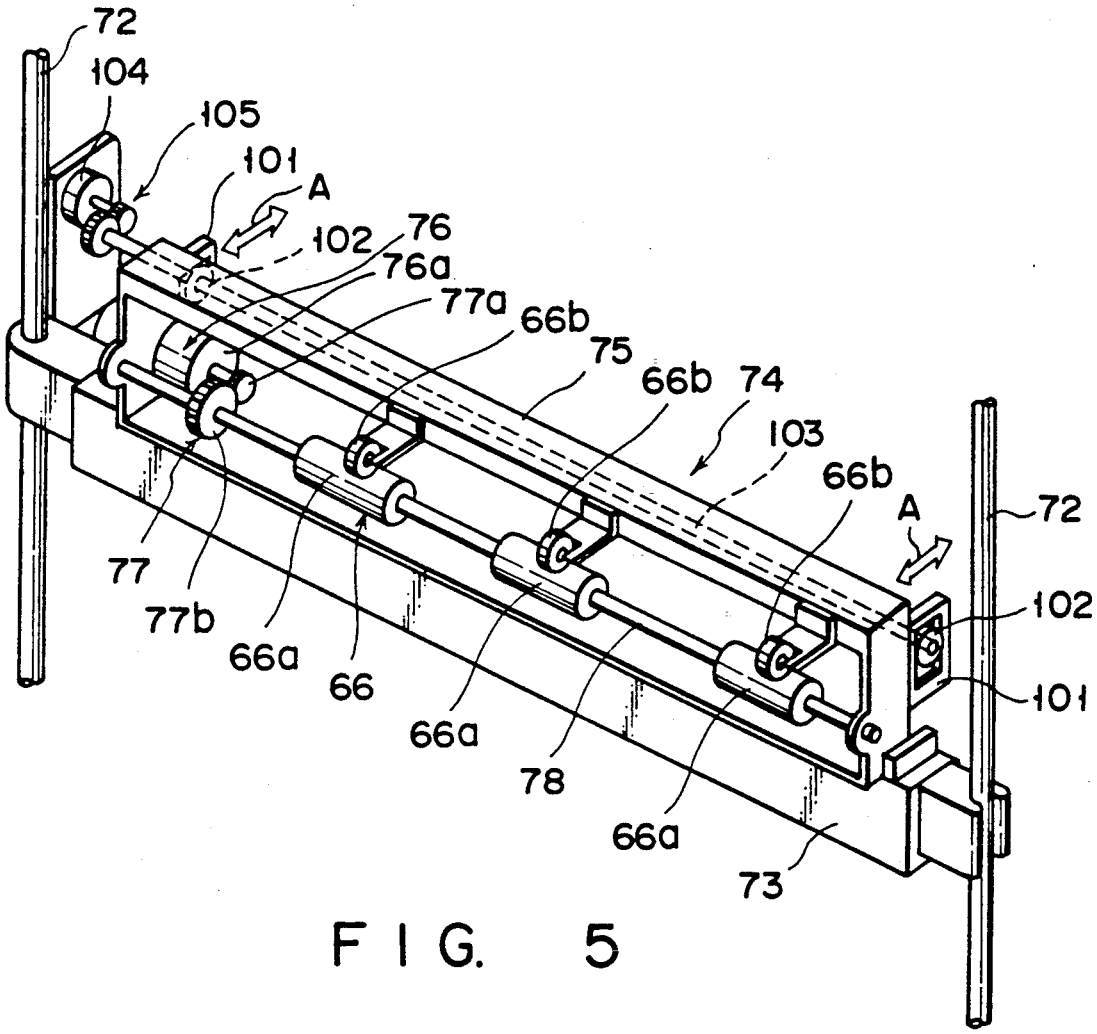

The roller unit 74 has a support frame 75 which is mounted on the movable rest 73 to be slidable horizontally as indicated by arrow A in FIG. 5, and a feed roller assembly 66 supported by the frame 75. The assembly 66 has a plurality of lower rollers **66*a* fixedly supported on a shaft 78 which is horizontally supported by the frame 75, and a plurality of upper rollers 66*b*, which are rotatably supported by the frame 75 and are in contact with the lower rollers 66*a*, respectively. The lower rollers 66*a* rotate when the shaft 78 is rotated by a drive portion 76 provided at the support frame 75. The drive portion 76 has a motor 76*a* and a power transmitting system 77 having gears 77*a* and 77*b* for transmitting the driving force of the motor to the shaft 78. It should be noted that the guide plates 70 of the movable guide 65 are integrally formed with the support frame 75**.

The ascent or descent of the movable unit 69 along the tray unit 15 brings the feed roller assembly 66 near to any desired receiving tray. In interlock with the vertical movement of the movable unit 69, the first and second pairs of movable guide plates 68 and 71 of the movable guide 65 swing around their respective pivots, and extends or contracts, thereby guiding the sheets of paper P discharged from the discharge rollers 32 in the body 1 to the assembly 66. In this way, the discharged sheets of paper P are distributed into the desired trays. The movable guide 65 becomes the shortest when the movable unit 69 is brought to face the uppermost tray **15*a*, whereas the movable guide 65 becomes the longest when the movable unit 69 is brought to face the lowermost tray 15*f***.

According to the above construction wherein both the movable unit 69 and the movable guide 65 are moved so as to distribute the sheets of paper P to the receiving trays **15*a* through 15*f***, the drive mechanisms can be reduced in size and required driving power and drive source can be minimized, in comparison with the conventional structure wherein the whole of the tray unit is moved upwards or downwards with the sheets of paper in it.

The support frame 75 of the roller unit 74 is mounted on the movable rest 73 to be slidable in the direction indicated by arrow A in FIG. 5, i.e., to be movable toward or away from the tray unit 15. The sorter 13 includes a roller shifting mechanism 100 for moving the support frame 75 along with the feed roller assembly 66 towards the tray unit 15 when the roller assembly 66 feeds a sheet of paper P into the tray unit 15, whereas moving the support frame away from the tray unit when the movable unit 69 moves upward or downward.

Figure 6:
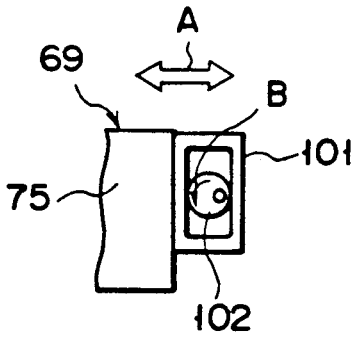

As shown in FIGS. 5 and 6, the shifting mechanism has a pair of guide frames 101 extending backward from the respective ends of the support frame 75, and eccentric cams 102 rotatably fitted in the respective guide frames 101. The eccentric cams 102 are connected with each other through a horizontally extending shaft 103, which is rotatably supported by the movable rest 73. The eccentric cams 102 are rotated by 180 degrees at a time through a gearing mechanism 105 and the shaft 103 by means of a motor 104 provided on the movable rest 73, thereby moving the support frame 75 and roller assembly 66 forward and backward as indicated by arrow A.

Figure 7:
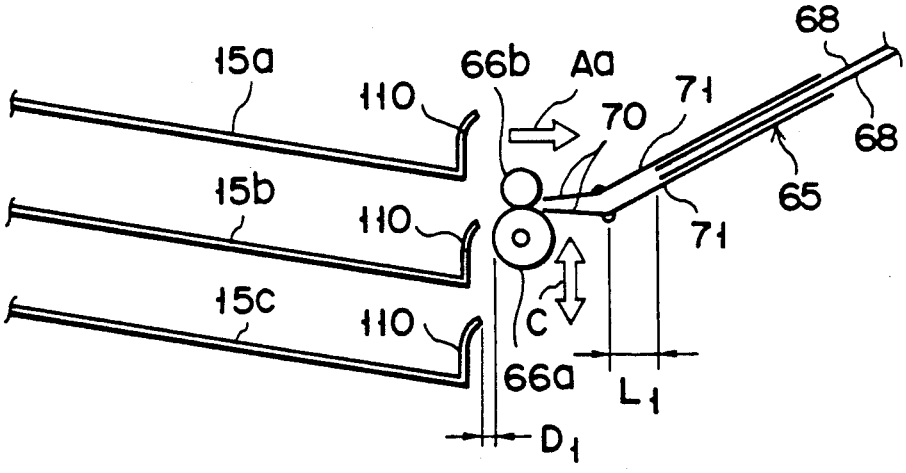
Figure 8:
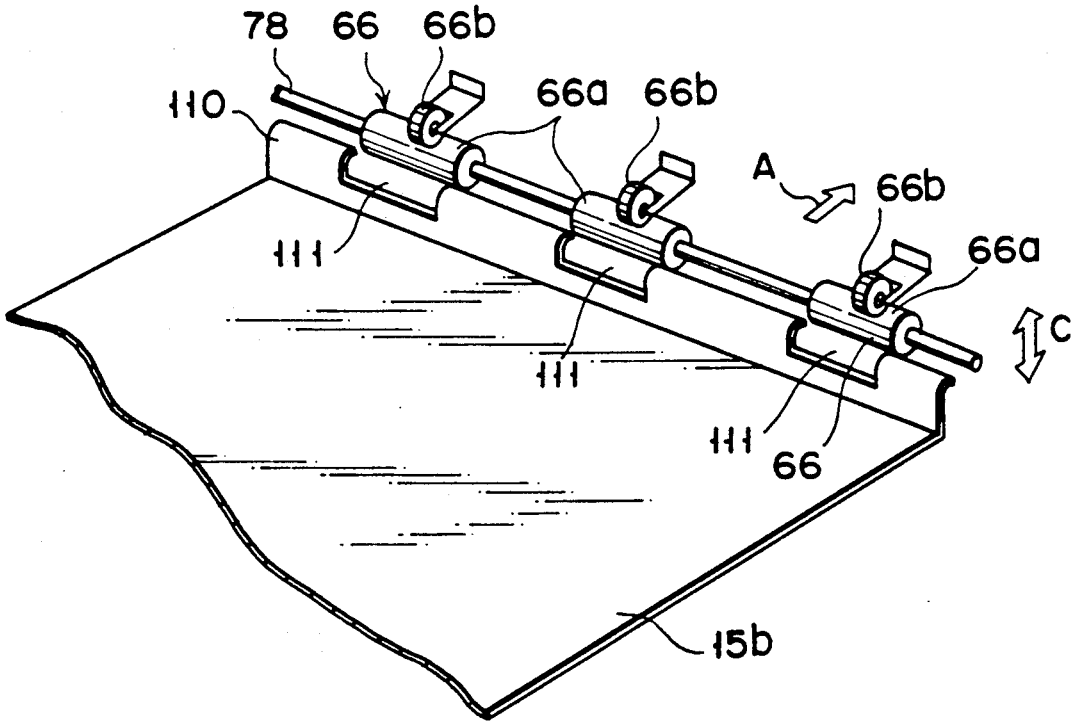

As shown in FIGS. 7 and 8, when the movable unit 69 moves upwards or downwards along the tray unit as indicated by arrow C, the feed roller assembly 66 is moved in a direction indicated by arrow Aa by the roller shifting mechanism and held in the remote position shown in FIG. 7. In the remote position, the lower rollers **66*a* are apart from the side wall 110 of each tray by a distance D1. Therefore, the movable unit 69 smoothly ascends or descends without the feed rollers 66 being in touch with the tray unit 15. Then, the movable unit 69 is stopped when the feed roller assembly 66 face a desired receiving tray, for example, the tray 15*b***.

Figure 9:
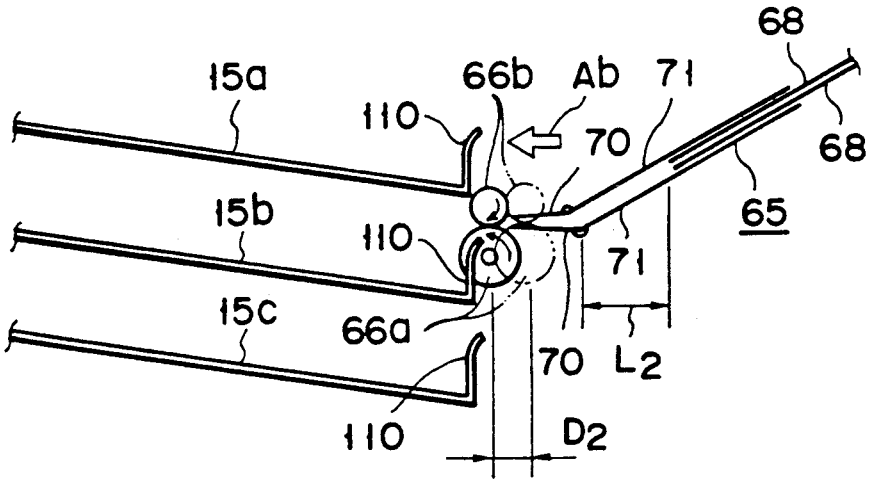
Figure 10:
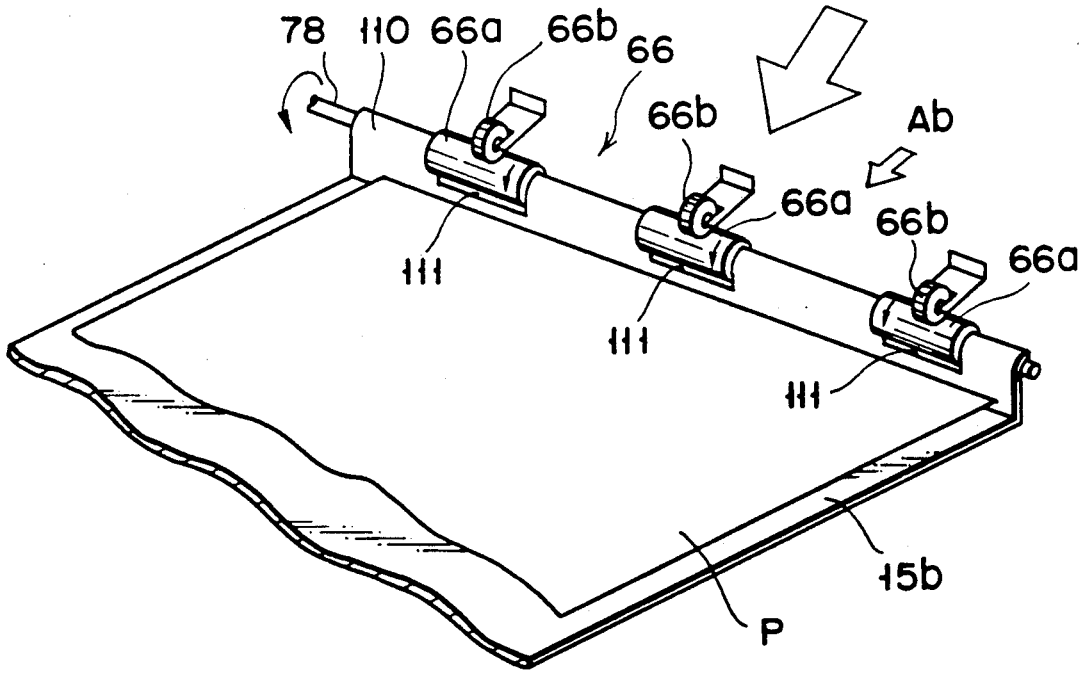

As shown in FIGS. 8 through 10, the side wall 110 of each receiving tray has a notch 111 for receiving part of the corresponding lower roller **66*a* of the roller assembly 66. Upon feeding a sheet of paper P, the feed roller assembly 66 is moved from the remote position in a direction indicated by arrow Ab by a distance D2 by means of the shifting mechanism 100, and is set at a feeding position indicated by solid lines in FIG. 9. In the feeding position, each of the lower rollers 66*a* is partly received in the corresponding notch 111 of the receiving tray 15*b*, so that part of the outer circumference of each roller 66*a* slightly projects from the side wall 110 into the inside of the tray 15*b*. Therefore, the sheet of paper P can be surely fed from the roller assembly 66 into the tray 15*b* as shown in FIG. 10, without its rear end being caught by the side wall 110 of the tray 15*b***.

Even if the support frame 75 supporting the roller assembly 66 slides in the direction of arrow A, the movable guide 65 compensates for the distance, over which the frame moves, by its extension or contraction. Therefore, change in distance (L1 in FIG. 7 and L2 in FIG. 9) between the distal ends of the guide plates 68 and the connections between the guide plates 70 and 71 in accordance with the movement of the support frame 75 will never affect the feeding operation for the sheets of paper P.

Figure 11:
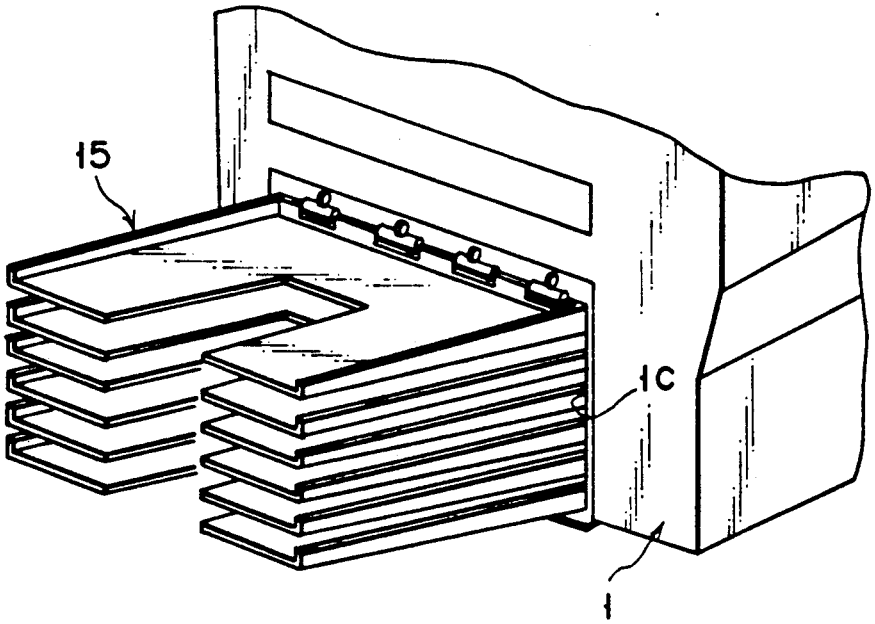
Figure 12:
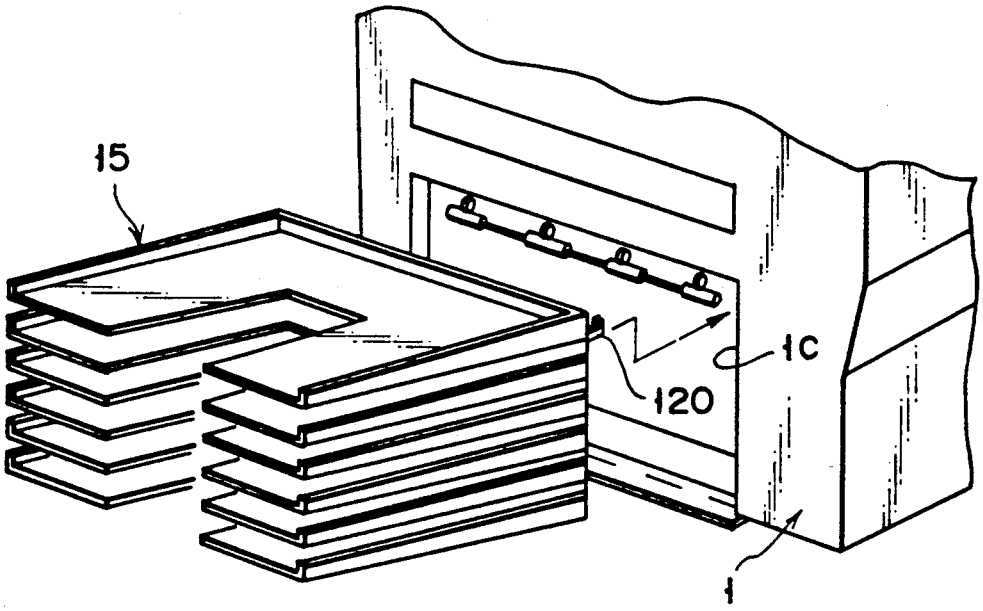

As shown in FIGS. 11 and 12, the tray unit 15 is constructed to be detachably attached to the fitting portion 1c of the apparatus body 1. Specifically, the tray unit 15 has at its rear portion a pair of hooks 120 (only one of them is shown). By engaging the hooks 120 with the engagement portions provided in the body 1, the tray unit is detachably attached to the body. When the tray unit 15 is detached from the body 1, the package and transfer of the image forming apparatus will be performed easily.

According to the sorter having the above-mentioned structure, when a sheet of paper is being fed into any one of the tray unit, the feed rollers can be brought to the feeding position which is near the tray unit, to eliminate a space between the feed rollers and the tray, so that the sheet of paper will surely be fed onto the tray. When the feed roller assembly moves upwards or downwards along the tray unit, the roller assembly is moved to the position remote from the tray unit. Therefore, the roller assembly can be smoothly moved to a position in front of any desired receiving tray without touching the tray unit.

It should be noted that the present invention is not limited to the above described embodiment, but may be variously modified within the scope of the present invention.

In the above embodiment, for instance, each of the lower rollers of the feed roller assembly is partly received in the notch of the side wall of any one of the receiving trays at the feeding position, in order to ensure feeding of sheets of paper. However, the same advantage as the above embodiment will be obtained only if the lower rollers are so close to any of the tray that no space is present between them. Therefore, the notches may be omitted.

Further, the roller shifting mechanism is not limited to the combination of the eccentric cams and the motor, but it may be constructed by a solenoid-plunger assembly.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An apparatus for sorting sheets of paper, having a predetermined portion, said apparatus comprising:

means for receiving the sheets of paper, said receiving means having a plurality of paper receiving portions;

means for feeding the sheets of paper from the predetermined portions onto the receiving means;

first moving means for moving said feeding means to a position facing a specified one of the paper receiving portions; and second moving means for moving, independently of said first moving means, said feeding means such that said feeding means approaches from said position to said specified receiving means when the feeding means feeds the sheets of paper into the receiving means, after the movement of said feeding means by said first moving means, said second moving means being arranged to be movable along with the feeding means.

2. An apparatus according to claim 1, wherein said receiving portions are stacked in a predetermined direction with predetermined intervals.

said feeding means including a support rest movable in said predetermined direction, a support member mounted on the support rest to be movable between a feeding position close to the paper receiving means and a remote position remote from the paper receiving means, and a feed roller assembly supported by the support member and movable, together with the support member, between the feeding position and the remote position.

3. An apparatus according to claim 2, wherein said second moving means includes means for shifting the support member between the feeding position and the remote position.

4. An apparatus according to claim 3, wherein said shifting means has an eccentric cam engaging the support member, and means for rotating the eccentric cam.

5. An apparatus according to claim 2, which further comprises means for guiding sheets of paper from said predetermined portion to said feeding means, said guiding means being telescopic in accordance with the movement of the feeding means by said first moving means.

6. An apparatus according to claim 5, wherein said guiding means includes a pair of first parallel guide plates extending from the predetermined portion towards the paper receiving means, a pair of first movable parallel guide plates pivotally coupled with respective extended ends of the first guide plates, a pair of second parallel guide plates extending from the support member towards the predetermined portion, and a pair of second movable parallel guide plates pivotally coupled with respective extended ends of the second guide plates, the first movable guide plates being slidably fitted between the second movable guide plates.

7. An apparatus according to claim 1, wherein said paper receiving means includes a plurality of paper receiving trays, stacked substantially vertically and constitute said the paper receiving portions, respectively, and said feeding means includes a plurality of rollers, each roller being partly located above a corresponding one of the receiving trays when the feeding means is approached to said receiving means by said second moving means.

8. An apparatus according to claim 7, wherein each of said paper receiving trays has a side edge located on the side of the feeding means, a side wall standing at the side edge, and a plurality of notches formed in the side wall for partly receiving the rollers of the feeding means when the feeding means approaches the receiving means.

9. An apparatus for sorting sheets of paper discharged from a predetermined portion comprising:

means for receiving sheets of paper, said receiving means having a plurality of paper receiving portions stacked in a predetermined direction at predetermined intervals;

a movable unit movable in the predetermined direction along the paper receiving means;

first moving means for moving the movable unit to a position facing a desired one of the paper receiving portions;

means for guiding the sheets of paper discharged from the predetermined portion to the movable unit;

means arranged on said movable unit, for feeding the sheets of paper guided by the guiding means into the paper receiving means, said feeding means being movable between a feeding position close to the paper receiving means and a position wherein the feeding means is remote from the paper receiving means and prevented from interfering with the paper receiving means; and second moving means for moving, independently of said first moving means, the feeding means to the feeding position when the feeding means feeds the sheets of paper into the receiving means, and moving the feeding means to the remote position when the movable unit moves in said predetermined direction, said second moving means being mounted on the movable unit and movable together with the movable unit in said predetermined direction.

10. An apparatus according to claim 9, wherein said guiding means includes a pair of first parallel guide plates extending from the predetermined portion towards the paper receiving means, a pair of first movable parallel guide plates pivotally coupled with respective extended ends of the first guide plates, a pair of second parallel guide plates extending from the movable unit towards the predetermined portion, and a pair of second movable parallel guide plates pivotally coupled with respective extended ends of the second guide plates, the first movable guide plates being slidably fitted between the second movable guide plates.

11. An image forming apparatus comprising:

a body having a fitting portion opening outside;

means arranged in the body for forming images on image transfer materials;

a discharge portion for discharging the image transfer materials, on which images are transferred toward the fitting portion; and a sorter for sorting the image transfer materials discharged from the discharge portion, said sorter including:

means for receiving the image transfer materials, said receiving means having a plurality of receiving portions and being detachably attached to the fitting portion, the receiving portions being stacked in a predetermined direction at predetermined intervals;

means for feeding the image transfer materials into the receiving means, said feeding means being movable in the predetermined direction along the receiving means;

a first moving means for moving the feeding means to a position facing a desired one of the receiving portions;

means for guiding the image transfer materials discharged from the discharge portion to the feeding means; and second moving means for moving, independently of said first moving means, the feeding means such that said feeding means approaches from said position to the receiving means when the feeding means feeds the image transfer materials into the receiving means, after said feeding means is moved to said position by said first moving means, said second moving means being movable together with the feeding means in said predetermined direction.

12. An apparatus according to claim 1, wherein said second moving means includes a drive source movable together with the feeding means, for moving the feeding means toward the receiving means, and means for actuating the drive source when the feeding means is in a position facing a specified paper receiving portion.

13. An apparatus according to claim 9, wherein said second moving means includes an eccentric cam arranged on the movable unit and engaging the feeding means, and means arranged on the movable unit, for rotating the eccentric cam.

* * * * *